US007063029B1

(12) United States Patent
Tsui et al.

(10) Patent No.: US 7,063,029 B1
(45) Date of Patent: Jun. 20, 2006

(54) UMBRELLA, UMBRELLA COVER, AND METHOD OF MAKING

(75) Inventors: Hay Man Tsui, Toronto (CA); Harry Campbell, New Smyrna Beach, FL (US); Joel Greenstein, Daytona Beach, FL (US)

(73) Assignee: Hot Off The Press Promotions, Inc., Daytona Beach, FL (US)

( * ) Notice: Subject to any disclaimer, the term of this patent is extended or adjusted under 35 U.S.C. 154(b) by 361 days.

(21) Appl. No.: 10/723,579

(22) Filed: Nov. 26, 2003

Related U.S. Application Data

(60) Provisional application No. 60/429,305, filed on Nov. 26, 2002.

(51) Int. Cl.
*A45B 25/18* (2006.01)
*D05B 35/00* (2006.01)

(52) U.S. Cl. ..... 112/475.06; 112/475.08; 135/33.2

(58) Field of Classification Search ..... 112/475.06, 112/475.08, 122, 147, 153, 470.17, 162; D3/5, 10; 135/15.1, 33.2, 33.5
See application file for complete search history.

(56) References Cited

U.S. PATENT DOCUMENTS

| | | | | |
|---|---|---|---|---|
| 48,267 A | | 6/1865 | Fee | |
| 67,405 A | | 8/1867 | Brown | |
| 218,382 A | | 8/1879 | Gruyer | |
| 2,051,750 A | | 8/1936 | Siers | |
| 2,111,578 A | | 3/1938 | Weaver | |
| 2,985,179 A | | 5/1961 | Givens | |
| 4,481,895 A | * | 11/1984 | Asao et al. | 112/78 |
| 4,794,939 A | | 1/1989 | Okuda | |
| 5,000,211 A | * | 3/1991 | Speare et al. | 135/97 |
| 5,020,559 A | | 6/1991 | Lai | |
| 5,213,123 A | * | 5/1993 | Whitfield | 135/27 |
| 5,488,966 A | | 2/1996 | Baldwin et al. | |
| 5,671,935 A | * | 9/1997 | Berger et al. | 280/743.1 |
| 5,806,546 A | | 9/1998 | Ni | |
| 6,302,125 B1 | | 10/2001 | Lin et al. | |
| 6,695,346 B1 | * | 2/2004 | Keshavaraj | 280/743.1 |

FOREIGN PATENT DOCUMENTS

JP 1-236005 * 9/1989

* cited by examiner

*Primary Examiner*—Ismael Izaguirre
(74) *Attorney, Agent, or Firm*—Allen, Dyer, Doppelt, Milbrath & Gilchrist, P.A.

(57) ABSTRACT

An umbrella cover if formed from a unitary piece of material, an octagonal piece of material having eight corners, which may be decorated, such as by printing, without image segmentation. The cover has eight generally triangular slits therein extending one from each corner of the octagon toward, but in spaced relation from, a center point, a point of each triangle at the inner end of the slit. The sides of each slit are sewn together to form a dart. The cover is tacked to an eight-rib frame, with each dart tacked adjacent a flexion point in a rib.

18 Claims, 6 Drawing Sheets

UMBRELLA, UMBRELLA COVER, AND METHOD OF MAKING

CROSS-REFERENCE TO RELATED APPLICATION

This application claims priority to provisional application Ser. No. 60/429,305, filed on Nov. 26, 2002, "Umbrella and Associated Methods."

BACKGROUND OF THE INVENTION

1. Field of the Invention

The present invention relates to umbrellas and methods for constructing same.

2. Background of the Invention

Standard umbrellas comprise a frame having eight ribs extending outwardly from a center shaft. The ribs support a cover when in the open position. The cover is constructed by sewing together eight triangular pieces of material. The sewing process creates a natural curve to the cover material that allows it to conform to the shape of the frame. The cover is then tacked to the ribs along each of the eight seams. Each tack is positioned approximately 10–12 inches from the outer tip of the rib.

Decorated umbrellas are typically made by screen printing the triangles of material prior to sewing the triangles together onto the ribs of the eight-rib frame. This causes a design to be segmented rather than appearing unitary.

One umbrella having a one-piece cover is known in the art that comprises a stretchable, unseamed material glued onto a 16-rib frame. The frame is oversized and flatter than customary umbrellas, and is believed more expensive to fabricate than standard umbrellas. Further, such prior art umbrellas have a hemmed outer edge.

SUMMARY OF THE INVENTION

A first aspect of the present invention is directed to an umbrella cover. The umbrella cover of the present invention comprises a unitary piece of material that can be decorated, such as by printing, without segmentation. The cover comprises an octagonal piece of material having eight corners. The cover has eight generally triangular slits therein extending one from each corner of the octagon toward, but in spaced relation from, a center point, a point of each triangle at the inner end of the slit. The sides of each slit are sewn together to form a dart.

A second aspect of the present invention is directed to an umbrella. The umbrella comprises a cover as described above and a frame to which the cover is affixed. The cover is affixed to an eight-rib frame, with each dart tacked adjacent a flexion point in a rib.

A third aspect of the invention is directed to a method of fabricating an umbrella cover. The method comprises the steps of cutting eight generally triangular slits in an octagonal piece of material, the slits extending inward from each corner of the octagonal piece of material toward, but in spaced relation from, a center point of the material. Darts are formed by sewing together the sides of each slit.

A fourth aspect of the present invention is directed to a method of fabricating an umbrella. The method comprises the steps of making an umbrella cover as described above. Each dart is then tacked adjacent a flexion point in a rib of an eight-rib frame.

In an alternate embodiment, believed at present to represent a best mode of the umbrella of the present invention, the method of making an umbrella cover comprises the steps of folding a substantially octagonal unitary sheet of fabric in half along a line extending approximately from a midpoint of a first side to a midpoint of a second side. The second side is generally opposed to the first side. Being octagonal, the sheet has eight sides, each adjacent two sides meeting at a corner.

A slit is cut at each corner, each slit extending from the respective corner to an apex toward, but in spaced relation from, a centerpoint of the sheet. The slit is substantially isosceles triangular in shape. For each slit, opposing sides thereof are joined together to form darts. Finally, piping is affixed along the eight sides.

In a general case, one of skill in the art will appreciate that the invention is not intended to be limited to an octagonal element, and that any polygon could in principle be used with a correspondingly ribbed frame with the same technique to create an umbrella cover and umbrella.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

A description of the preferred embodiments of the present invention will now be presented with reference to FIGS. 1–6.

Figure 1:
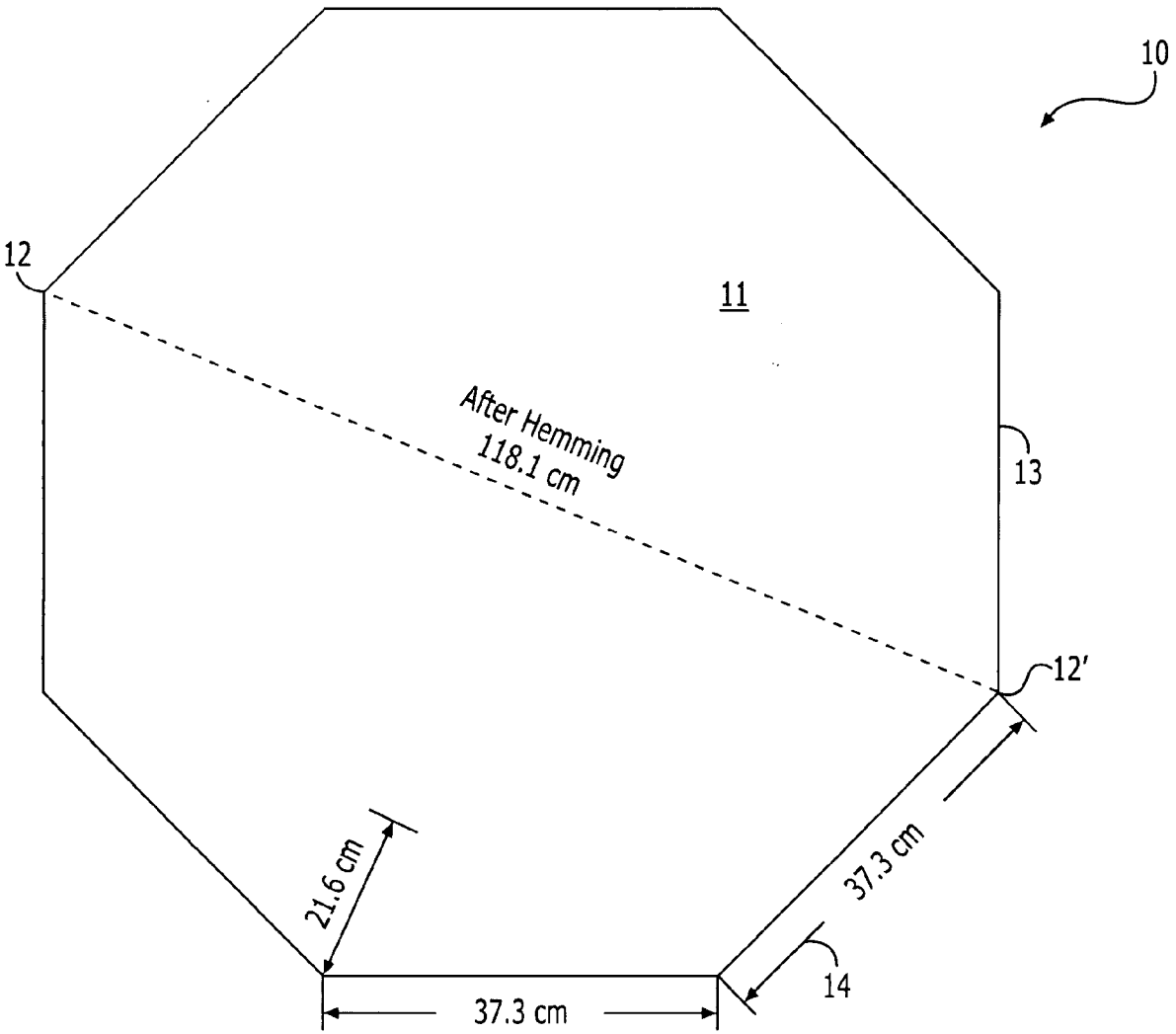
FIG. 1 is a top plan view of a template for a first embodiment of an umbrella cover of the present invention.
Figure 2:
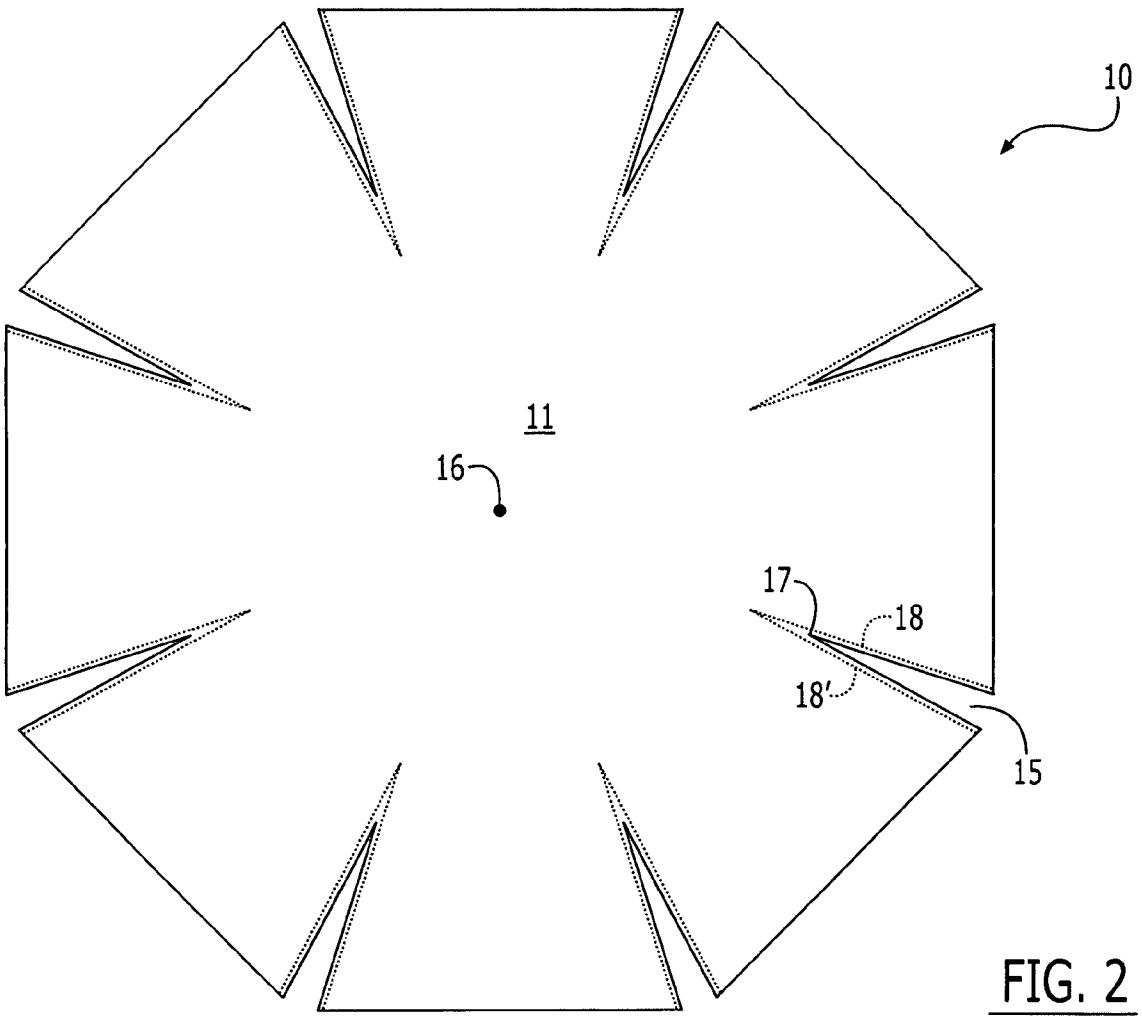
FIG. 2 is a top plan view of an umbrella cover of FIG. 1 prior to forming darts therein.
Figure 3:
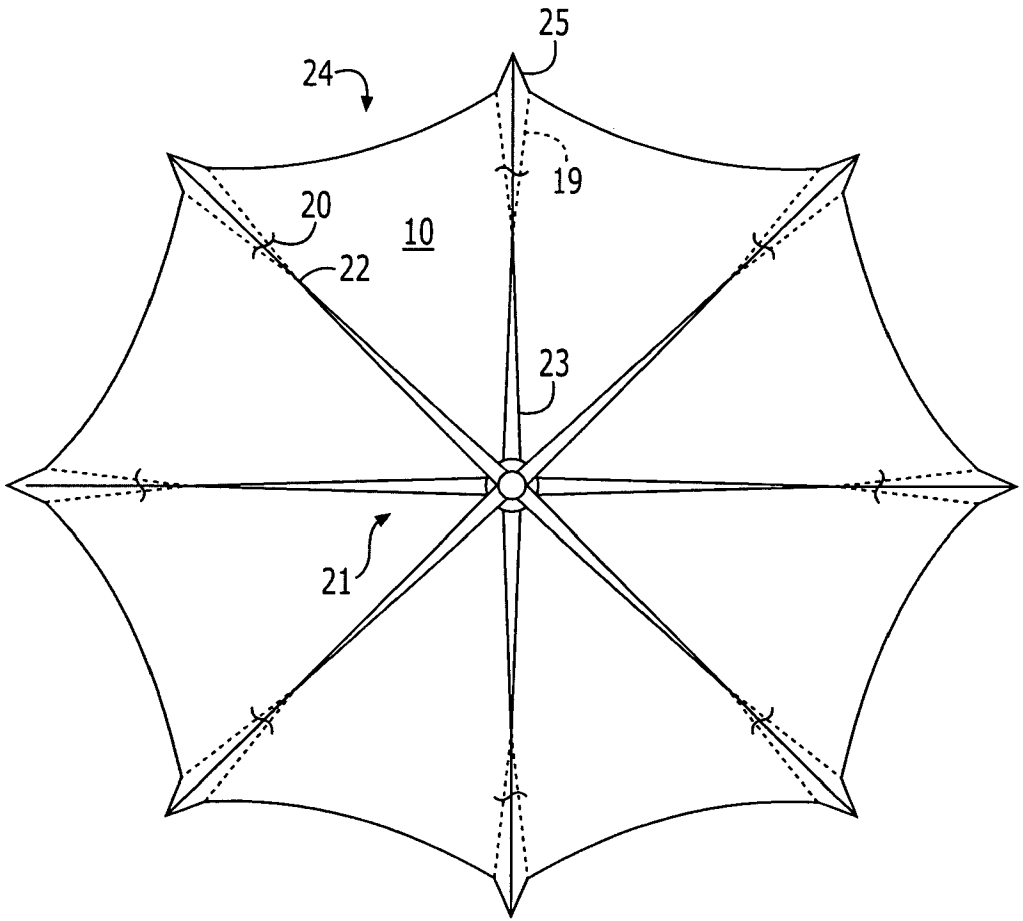
FIG. 3 is a bottom plan view of a portion of an umbrella of FIG. 1.
Figure 4:
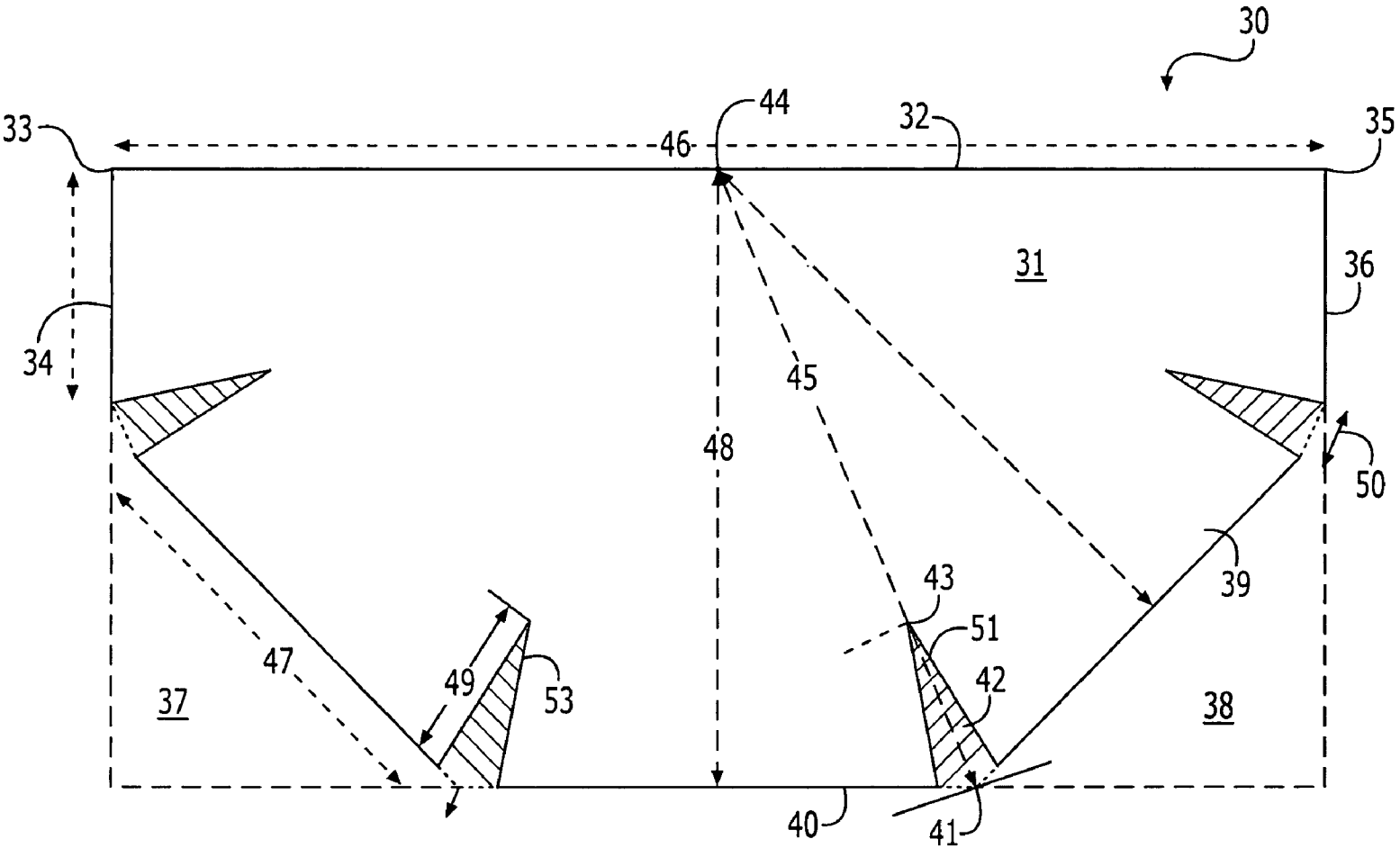
FIG. 4 is a top plan view of the folded and cut sheet of a second embodiment of the invention.

As stated above, a first embodiment of the invention comprises an umbrella and cover using an eight-rib frame (FIGS. 1–3). An umbrella cover 10 comprises a unitary piece of material 11 as shown in FIG. 1, having the exemplary measurements shown thereon. The cover 10 comprises an octagonal piece of material 11 having eight corners 12. In the embodiment shown, the material piece 11 extends 118.1 cm between diametrically opposed corners 12,12'. Each side 13 has a length 14 of 37.3 cm.

In a preferred embodiment, the material piece 11 comprises a woven material having substantially no elasticity, except along the bias. The material in an exemplary embodiment comprises either 75D×190T 100% nylon taffeta with acrylic coating for a screen-printed umbrella cover or 190T 100% polyester with P.U. coating for a four-color process paper transfer printing. The cutting technique preferably avoids the bias to avoid substantial stretching, which would cause uneven tension around the perimeter of the cover and an ill fit on the frame.

The cover 10 has eight generally triangular slits 15 therein (FIG. 2) extending one from each corner 12 of the octagon 11 toward, but in spaced relation from, a center point 16, a point 17 of each triangular slit 15 at the inner end thereof. In the embodiment shown, the slit 15 is approximately 21.6 cm long. The sides 18,18' of each slit 15 are sewn together to form a dart 19 (FIG. 3). The cover 10 is tacked 20 to an eight-rib frame 21, with each dart 19 tacked adjacent a flexion point 22 in a rib 23, to form a 46-inch umbrella 24. Preferably the tacking point is approximately 8 inches from the outer tip 25 of the rib 23.

The method of fabricating an umbrella 24 and cover 10 comprises the steps of cutting eight generally triangular slits in an octagonal piece of material, the slits extending inward from each corner of the octagonal piece of material toward, but in spaced relation from, a center point of the material. A desired graphic or indicia may be printed on the cover 10, with the one-piece cover permitting the printing of a unitary graphic that does not have to be pieced together. Darts are formed by sewing together the sides of each slit. Each dart is then tacked adjacent a flexion point in a rib of an eight-rib frame.

A second embodiment of an umbrella cover 30 (FIGS. 4–6), believed at the time of filing to represent a preferred embodiment, is made by folding a folding a substantially square sheet of fabric 31 in half along a line 32 extending approximately from a midpoint 33 of a first side 34 to a midpoint 35 of an opposed second side 36 to form two substantially equal-area rectangles. In a preferred embodiment, the sheet comprises nylon material, such as 190T nylon. Each of the two free corners 37,38 is then cut off to form an octagonal sheet of fabric. Alternatively, the corners 37,38 could be cut off prior to folding.

The substantially octagonal unitary sheet of fabric now has eight sides, each adjacent two sides (for example, 39,40) meeting at a corner 41.

Next a slit 42 is cut at each corner, each slit extending from the respective corner 41 to an apex 43 toward, but in spaced relation from, a centerpoint 44 of the sheet. The slit 42 is substantially isosceles triangular in shape. In a particular embodiment, the slit 42 has a length approximately one-quarter a length 45 between a corner 41 and the centerpoint 44.

For each slit 42, with the sheet unfolded, opposing sides 53 thereof are then joined together to form darts 19, for example, by sewing the slit sides 53 together.

In an exemplary embodiment for a standard 8-panel umbrella, dimensions are as follows: side 46 of square piece of fabric, 113 cm; side 47 of octagonal sheet, 40.2 cm; length 48 from midpoint of fold 32 to midpoint of side 40, 55.5 cm; length 49 of slit side, 15.2 cm; base 50 of slit, 5.1 cm; and length 51 of dart, 20.3 cm.

Figure 5:
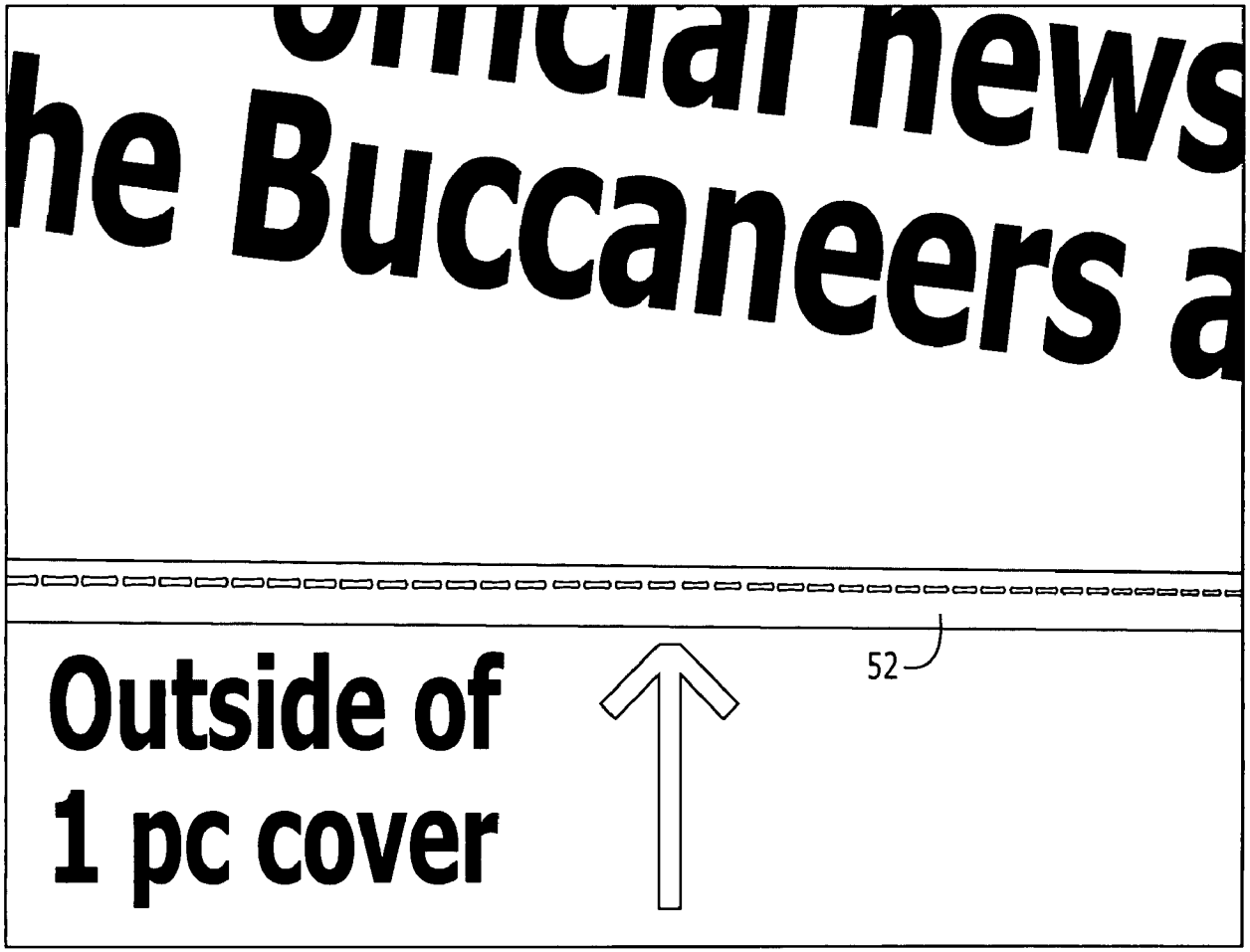
FIG. 5 illustrates the outside of the cover of FIG. 4 with piping thereon.
Figure 6:
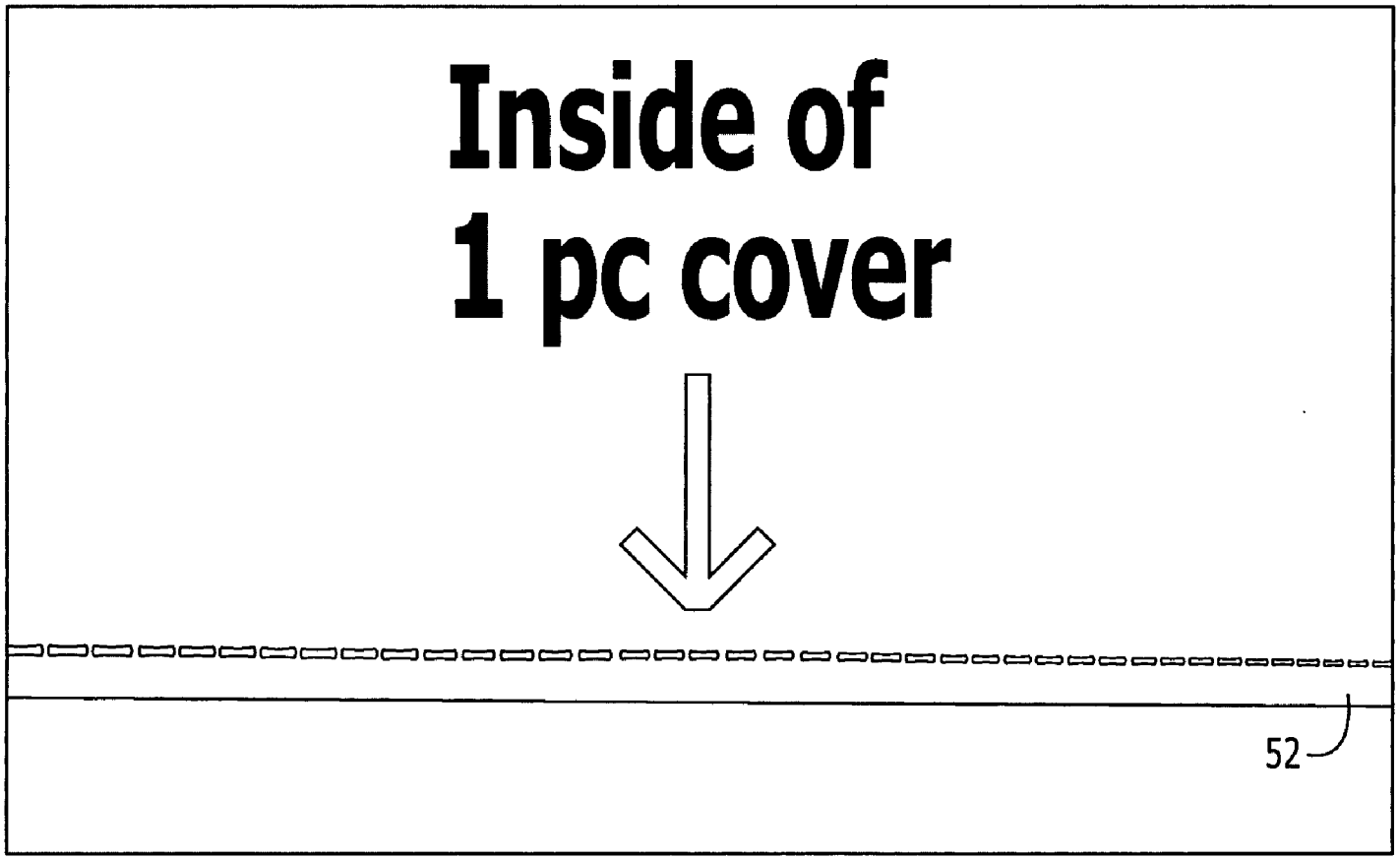
FIG. 6 illustrates the inside of the cover of FIG. 4 with piping thereon.

Finally, piping 52 is affixed along the eight sides, for example, by sewing the piping 52 around a periphery of the cover (FIGS. 5 and 6). The sewing of the piping 52 may be accomplished with the use of, for example, an edge binder pipe. Preferably the piping 52 comprises a same material as the fabric sheet, most preferably a nylon material such as 190T nylon. For the exemplary measurements given above, the piping material comprises an elongated strip 320 cm long and 2.25 cm wide.

The piping 52 has been found to be an important feature of this embodiment 30, since it has been found to reinforce the cover 30, permitting the cover 30 to be stretched to fit the frame and minimize wrinkles in the finished product.

In order to complete an umbrella, each dart 19 is affixed to a frame rib 23 as in FIG. 3.

It will be understood by one of skill in the art that the measurements presented herein for both embodiments 10,30 are exemplary, and not intended to be limiting, and that other sizes are easily contemplated by one of skill in the art, including other polygonal cover/rib number combinations, other cover materials, and other dimensions.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

What is claimed is:

1. A method of making an umbrella cover comprising the steps of:

folding a substantially octagonal unitary sheet of fabric, the sheet having eight sides, each adjacent two sides meeting at a corner, in half along a line extending approximately from a midpoint of a first side to a midpoint of a second side, the second side opposed to the first side;

cutting a slit at each corner, each slit extending from the respective corner to an apex toward, but in spaced relation from, a centerpoint of the sheet, the slit substantially isosceles triangular in shape;

joining, for each slit, opposing sides thereof together to form darts; and affixing piping along the eight sides.

2. The method recited in claim 1, wherein the sheet comprises a nylon material.

3. The method recited in claim 1, further comprising the step, prior to the folding step, of folding a substantially square sheet of fabric in half to form two substantially equal-area rectangles, and cutting off each free corner to form the octagonal sheet of fabric.

4. The method recited in claim 1, further comprising the step, prior to the folding step, of cutting corners from a substantially square sheet of fabric to form the octagonal sheet of fabric.

5. The method recited in claim 1, wherein the slit has a length approximately one-quarter a length between a corner and the centerpoint.

6. The method recited in claim 1, wherein the joining step comprises sewing the slit sides together.

7. The method recited in claim 1, wherein the piping comprises a same material as the fabric sheet.

8. The method recited in claim 7, wherein the fabric sheet and the piping material comprise a nylon material.

9. The method recited in claim 1, wherein the affixing step comprises sewing the piping around a periphery of the cover.

10. A method of making an umbrella comprising the steps of:

folding a substantially octagonal unitary sheet of fabric, the sheet having eight sides, each adjacent two sides meeting at a corner, in half along a line extending approximately from a midpoint of a first side to a midpoint of a second side, the second side opposed to the first side;

cutting a slit at each corner, the each extending from the respective corner to an apex toward, but in spaced relation from, a centerpoint of the sheet, the slit substantially isosceles triangular in shape;

joining, for each slit, opposing sides thereof together to form darts;

affixing piping along the eight sides; and affixing each dart to a frame rib.

11. The method recited in claim 10, wherein the sheet comprises a nylon material.

12. The method recited in claim 10, further comprising the step, prior to the folding step, of folding a substantially square sheet of fabric in half to form two substantially equal-area rectangles, and cutting off each free corner to form the octagonal sheet of fabric.

13. The method recited in claim 10, further comprising the step, prior to the folding step, of cutting corners from a substantially square sheet of fabric to form the octagonal sheet of fabric.

14. The method recited in claim 10, wherein the slit has a length approximately one-quarter a length between a corner and the centerpoint.

15. The method recited in claim 10, wherein the joining step comprises sewing the slit sides together.

16. The method recited in claim 10, wherein the piping comprises a same material as the fabric sheet.

17. The method recited in claim 16, wherein the fabric sheet and the piping material comprise a nylon material.

18. The method recited in claim 10, wherein the piping affixing step comprises sewing the piping around a periphery of the cover.

* * * * *